US007708497B2

(12) United States Patent
Wilcox

(10) Patent No.: US 7,708,497 B2
(45) Date of Patent: May 4, 2010

(54) FLOATING PLATFORM AND METHOD OF CONSTRUCTING THE SAME

(75) Inventor: Paul E. Wilcox, Kirkland, WA (US)

(73) Assignee: Waterfront Construction, Inc., Seattle, WA (US)

( * ) Notice: Subject to any disclaimer, the term of this patent is extended or adjusted under 35 U.S.C. 154(b) by 693 days.

(21) Appl. No.: 11/552,601

(22) Filed: Oct. 25, 2006

(65) Prior Publication Data

US 2008/0101871 A1 May 1, 2008

(51) Int. Cl.
*E01D 15/14* (2006.01)
*B63B 35/88* (2006.01)

(52) U.S. Cl. ..... 405/219; 14/6; 14/27; 114/263

(58) Field of Classification Search ..... 405/218, 405/219; 114/258, 263; 52/633, 634, 639, 52/643, 690; 14/6, 27
See application file for complete search history.

(56) References Cited

U.S. PATENT DOCUMENTS

| | | | | | |
|---|---|---|---|---|---|
| 10,887 | A * | 5/1854 | Fink | 14/4 |
| 1,920,831 | A * | 8/1933 | Zabriskie | 52/654.1 |
| 2,423,832 | A * | 7/1947 | Gearon | 14/27 |
| 2,892,433 | A * | 6/1959 | Walker | 114/266 |
| 3,024,753 | A * | 3/1962 | Benson, Jr. | 114/263 |
| 3,036,539 | A * | 5/1962 | Storey | 114/266 |
| 3,102,503 | A * | 9/1963 | Sheffield | 114/266 |
| 3,147,727 | A * | 9/1964 | Weiss, Jr. et al. | 114/266 |
| 3,289,621 | A * | 12/1966 | Sebring | 114/266 |
| 3,587,125 | A * | 6/1971 | McLeese | 14/6 |
| 4,007,507 | A * | 2/1977 | Hansen | 14/4 |
| 4,282,619 | A * | 8/1981 | Rooney | 14/6 |
| 4,355,431 | A * | 10/1982 | Diefendahl et al. | 14/27 |
| 4,489,659 | A * | 12/1984 | Kamohara et al. | 104/124 |
| 4,554,883 | A * | 11/1985 | Lane | 114/266 |
| 4,642,830 | A * | 2/1987 | Richard | 14/4 |
| 4,867,093 | A * | 9/1989 | Sullivan | 114/267 |
| 4,883,014 | A * | 11/1989 | Otis et al. | 114/263 |
| 4,912,795 | A * | 4/1990 | Johnson | 14/3 |
| 4,993,094 | A * | 2/1991 | Muller | 14/77.1 |
| 5,008,967 | A * | 4/1991 | Barrios et al. | 14/7 |
| 5,215,027 | A * | 6/1993 | Baxter | 114/266 |
| 5,651,154 | A * | 7/1997 | Ahlskog et al. | 14/6 |
| 5,771,655 | A * | 6/1998 | Strickland et al. | 52/745.2 |
| 5,823,715 | A * | 10/1998 | Murdoch et al. | 405/219 |
| 6,170,560 | B1 * | 1/2001 | Daily et al. | 164/516 |
| 6,539,571 | B1 * | 4/2003 | Forsyth | 14/14 |
| 6,993,879 | B1 * | 2/2006 | Cantley | 52/652.1 |
| 2005/0013668 | A1 * | 1/2005 | Nixon et al. | 405/218 |

* cited by examiner

*Primary Examiner*—Tara Mayo-Pinnock
(74) *Attorney, Agent, or Firm*—Seed IP Law Group PLLC

(57) ABSTRACT

A floating platform system comprises first and second outer longitudinal beam members securing a truss frame having a plurality of truss elements. The floating platform system may further include at least one biasing device exerting a force on the longitudinal beam members and/or the truss frame. The floating platform system may further include a platform interface and/or at least one flotation device secured to the longitudinal beam members and/or the truss frame. The floating platform system may further include a plurality of inner longitudinal beam members interposed between the platform interface and/or the flotation device and the outer longitudinal beam members and/or the truss frame.

23 Claims, 7 Drawing Sheets

FLOATING PLATFORM AND METHOD OF CONSTRUCTING THE SAME

BACKGROUND OF THE INVENTION

1. Field of the Invention

The present invention is generally related to platforms, and more particularly, to a floating platform system or apparatus and method of making the same.

2. Description of the Related Art

Shoreline landing structures such as docks have generally been subjects of challenging structural design because of adverse conditions in which they typically must persist. Some dock structures involve rows of wooden beams used for decking installed on a frame bed with support posts rooted in the ground beneath the water. However, the ground under water is typically soft and structural posts need to extend sufficiently far beneath the ground to provide adequate support for secondary supports and the decking. Equipment and tools required for underwater drilling and installation of posts could thus be expensive and the methods extremely difficult. Furthermore, such docks are generally rigid and their position does not vary with changing waterline or shoreline near which they are installed. Accordingly, at the time of construction, they must be sized to accommodate predictable changes in the proximate shoreline and waterline over their estimated lifetime.

In more recent times floating docks have emerged, which make use of pontoons to maintain the dock structure above the water surface. Although these docks are more flexible and easier to construct than those requiring wood posts, the floating docks have given rise to new obstacles. For example, the amount of material used in such docks results in heavy structures, presenting transport and floating difficulties. Additionally, in absence of posts in the ground, some floating docks incorporate structural decking, which adds to the complexity of the design and to the weight and price of the material and which limits the options for designs and materials used for decking. Moreover, since floating docks lack rigid grounded supports at their transverse boundaries, they may lack sufficient torsional rigidity and be vulnerable to instability when subjected to uneven loading on their decking or on their mooring on the sides of the dock.

A method of constructing and a system for a floating platform is needed that is compact, exhibits sufficient torsional rigidity, and is easy and cost-effective to construct.

BRIEF SUMMARY OF THE INVENTION

In one embodiment, a platform system for floating on a body of water, comprises, at least first and second longitudinal beam members, a truss frame positioned between the longitudinal beam members and oriented to extend in a plane at least substantially parallel to a surface of the body of water during use, and having a plurality of truss elements forming at least one apex oriented toward a transverse boundary of the floating platform system, and at least one biasing device operable to selectively apply a force toward at least one of the apices of the truss frame.

In another embodiment, a method of constructing a floating platform comprises, fabricating a truss frame from a plurality of truss elements forming a plurality of apices, respectively providing first and second outer longitudinal beam members toward opposing transverse boundaries of the truss frame, coupling the truss frame to the first and second outer longitudinal beam members, coupling respective ends of a biasing device to at least one of the truss frame and the outer longitudinal beam members, and manipulating the biasing device to distribute a compressive force to the truss frame and maintain a torsional rigidity of the floating platform.

In yet another embodiment, a method of inducing and maintaining a torsional rigidity of a floating platform comprises applying a transverse compressive force to at least a portion of the floating platform.

In still another embodiment, a method of inducing and maintaining a torsional rigidity of a floating platform having at least first and second outer longitudinal beam members, a truss frame having a plurality of truss elements forming a plurality of apices toward a transverse boundary of the floating platform system, and at least one biasing device operable to selectively apply a force in a substantially transverse direction toward at least one of the apices of the truss frame, comprises the steps of applying a compressive force from the biasing device to at least one of the first and second outer longitudinal beam members and the truss frame toward the apices of the truss frame, and distributing the compressive force to the truss elements of the truss frame to induce and maintain the torsional rigidity of the floating platform.

BRIEF DESCRIPTION OF THE SEVERAL VIEWS OF THE DRAWING(S)

DETAILED DESCRIPTION OF THE INVENTION

Figure 1A:
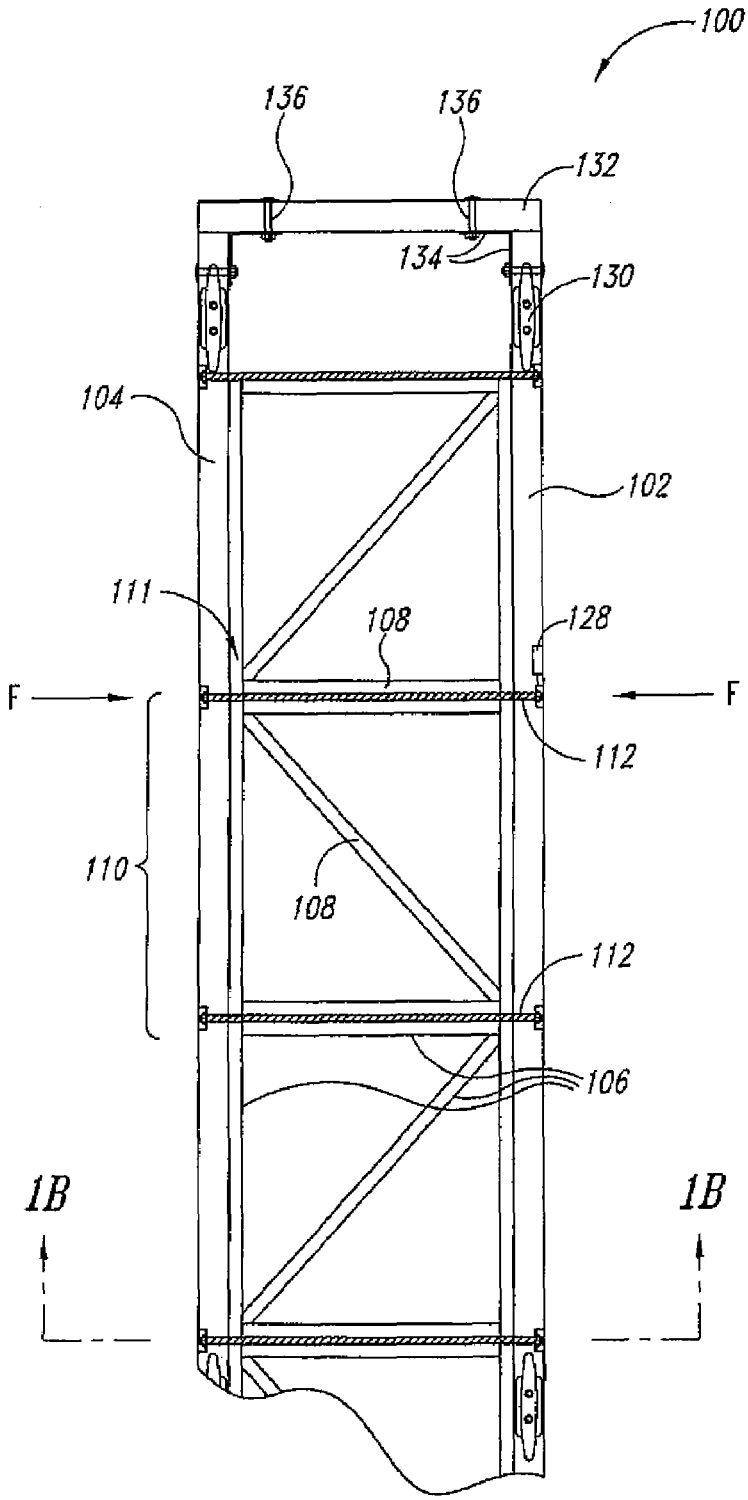
FIG. 1A is a partial top view of a floating platform system according to one embodiment of the present invention.

In one embodiment illustrated in FIG. 1A, a floating platform system 100 includes at least first and second outer longitudinal beam members 102, 104, each typically coinciding with a transverse boundary of the floating platform system 100. The floating platform system 100 further includes at least one truss frame 106 having a plurality of truss elements 108. The truss frame 106 can be one truss frame 106 extending through multiple longitudinal bays 110 or a plurality of truss frames 106, at least one truss frame 106 provided for each longitudinal bay 110. The truss elements 108 form at least one apex 111. The floating platform system 100 of the illustrated embodiment of FIG. 1A illustrates two of a plurality of apices 111 formed by the truss elements 108. The floating platform system 100 also includes at least one biasing device 112 extending in a substantially transverse direction and positioned to apply a force toward at least one of the apices 111.

The biasing device 112 can be operable to exert a compressive force F proximate the apices 111. The biasing device 112 can be a threaded assembly such as a compression rod assembly or it can include hydraulic means to exert the compressive force F. Additionally, or alternatively, the biasing device 112 can include at least one compressive spring (not shown) that are stretched and secured proximate the apices 111, their tendency to contract promoting the compressive force F on at least the truss frame 106. The biasing device 112 can be coupled to at least one of the truss frame 106 and the first and second outer longitudinal beam members 102, 104.

Figure 1B:
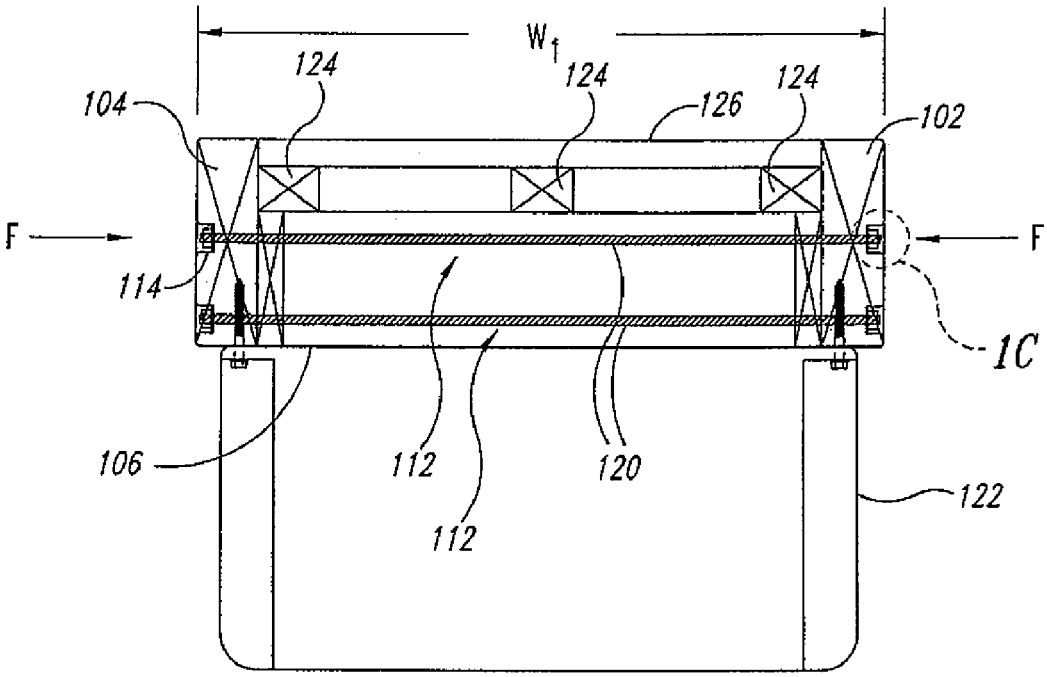
FIG. 1B is a cross-sectional view of the floating platform system of FIG. 1A, viewed along section 1B-1B.
Figure 1C:
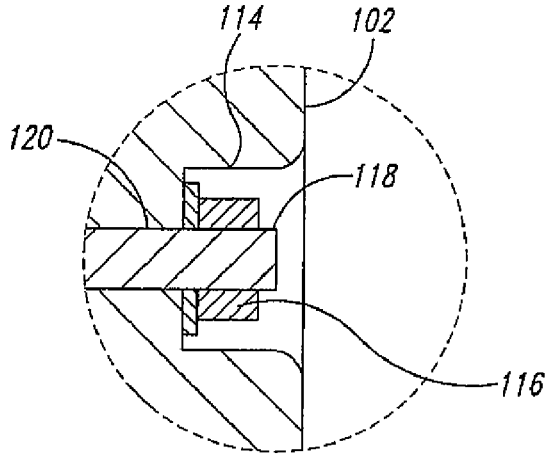
FIG. 1C is a close up view of a portion of the floating platform system of FIG. 1B.

FIG. 1B illustrates the biasing device 112 secured to the outer longitudinal beam members 102, 104 via coupling member 114. In a detail view, FIG. 1C illustrates an inner surface of a female member 116 of the biasing device 112 threadedly engaging an outer surface of a male member 118 of the biasing device 112. In this instance, the biasing device 112 includes a compression rod mechanism and a user may selectively control a magnitude of the compressive force F via fastening and/or unfastening of the female and male members 116, 118. The female members 116 on each end of the biasing device 112 are substantially secured to the outer longitudinal beam members 102, 104, respectively, via the coupling member 114. Accordingly, when the female and male members 116, 118 are fastened, the female members 116 transfer the compressive force F to the truss frame 106 either directly or indirectly through the outer longitudinal beam members 102, 104. The coupling member 114 and the female member 116 can be integrated and formed from a unitary body of material.

The biasing device 112 may also include an elongated member 120 extending between opposing male members 118. The male members 118 and the elongated member 120 can be formed from a unitary body of material such as metals, or they can be separate and removably or permanently attached to one another. For example, the elongated member 120 can be construction grade wire or wire braids captively received by the male members 118. Alternatively, the biasing device 112 may have female and male members 116, 118 at only one end of the biasing device 112, coupled to the first outer longitudinal beam member 102. In such embodiments, the other end of the biasing device 112 can be rigidly affixed to the truss frame 106 and/or the second outer longitudinal beam member 104. One of skill in the art having reviewed this disclosure can appreciate these and other variations that can be made to the biasing device 112 without deviating from the spirit of the invention.

The outer longitudinal beam members 102, 104 can be fabricated from a unitary body of material including, but not limited to, hard plastics, metals such as aluminum, steel, and titanium, and/or woods such as red cedar, redwood, cypress, eastern white cedar, Douglas fir, hemlock, and tamarack. Additionally, or alternatively, the outer longitudinal beam members 102, 104 can be fabricated from a composite including the said materials or additional composite or fibrous material such as carbon fiber. Alternatively, the outer longitudinal beam members 102, 104 can be waler beam assemblies comprising multiple layers that may include at least one kind of wood, adhesives, bonding material and other material promoting strength and stiffness of the outer longitudinal beam members 102, 104. Alternatively, the outer longitudinal beam members 102, 104 can be fabricated from any material that can bear stresses induced by a weight of the floating platform system 100 and typical design loads thereon, and that can distribute the compressive force F to the truss frame 106.

The truss frame 106 can be held in place via the compressive force F exerted on the truss frame 106 by the outer longitudinal beam members 102, 104 and generated by the biasing device 112. Additionally, or alternatively, the truss frame 106 can be secured to the outer longitudinal beam members 102, 104 using fastening means such as bonding, mechanical fasteners, mating of a curb of the truss frame 106 to a gutter in the outer longitudinal beam members 102, 104, or any other suitable fastening, connecting, or securing means. The outer longitudinal beam members 102, 104 provide longitudinal strength and rigidity, reacting to bending moments resulting from the weight of the floating platform system 100 and loads thereon. Furthermore, the outer longitudinal beam members 102, 104 transfer and distribute the compressive force F from the biasing device 112 to the truss frame 106.

The truss frame 106 can be a compact, effective, and inexpensive structure capable of resisting bending moments associated with loads on the platform system 100. The truss frame 106 can be fabricated from material including, but not limited to, hard plastics, metals such as aluminum, steel, and titanium, and/or woods such as red cedar, redwood, cypress, eastern white cedar, Douglas fir, hemlock, and tamarack. Additionally, the truss frame 106, when under compression forces applied by the biasing device 112, provides increased torsional rigidity of the floating platform system 100. As torsional loading typically induces stresses including transverse tensile stresses in dock structures, the truss frame 106 having been selectively preloaded with a compressive force will tend to resist such tensile stresses and minimize torsional instability.

Furthermore, the floating platform system 100 may include at least one flotation device 122 such as pontoons. FIG. 1B illustrates the flotation device 122 mechanically fastened to the outer longitudinal beam members 102, 104; however, the flotation device 122 can be secured to at least one of the truss frame 106 and the outer longitudinal beam members 102, 104 by any suitable securing means such as mechanical fasteners, water resistant bonding methods, and/or mating mechanisms. Additionally, or alternatively, a bottom portion of the truss frame 106 can be sized to allow space for a top portion of the flotation device 122 between the outer longitudinal beam members 102, 104. In such embodiments, the compressive force F can wholly or partially contribute to securing the flotation device 122 to the remainder of the floating platform system 100.

The floating platform system 100 may also include at least one upper inner longitudinal beam member 124. FIG. 1B illustrates an embodiment having a plurality of upper inner longitudinal beam members 124, such as sleeper beams. The upper inner longitudinal beam members 124 provide a seat upon which decking or any other structure that is desired on the floating platform system 100 can be mounted. For example, as shown in FIG. 1B, a platform interface 126 can be installed on the upper inner longitudinal beam members 124. Since the primary structural support of the floating platform system 100 is provided by the truss frame 106 and the outer longitudinal beam members 102, 104, the upper inner longitudinal beam members 124 and the platform interface 126 can be non-structural in applications where reducing the weight of the floating platform system 100 or allowing additional light to pass through is desired.

Alternatively, the upper inner longitudinal beam members 124 can be structural in applications in which additional longitudinal bending strength is desired such as in floating platforms 100 that are long and narrow. Additionally, or alternatively, the platform interface 126 can be structural in applications in which additional strength is required to resist shear forces such as applications involving large watercraft mooring.

The upper inner longitudinal beam members 124 and/or the platform interface 126 can be fabricated from composite decking material such as CHOICEDEK™ and/or material including, but not limited to, hard plastics, metals such as aluminum, steel, and titanium, and/or woods such as red cedar, redwood, cypress, eastern white cedar, Douglas fir, hemlock, and tamarack and/or compressed wood particles.

The inventors envision embodiments that incorporate additional features or exclude some of the above-stated features. For example, an embodiment of the floating platform system 100 may exclude the upper inner longitudinal beam members 124, directly seating the platform interface 126 on the truss frame 106. Additionally, or alternatively, as illustrated in FIG. 1A, the floating platform system 100 may include at least one load-cell 128 in communication with the biasing device 112 to display the magnitude of the compressive force F being applied to the truss frame 106.

Figure 2:
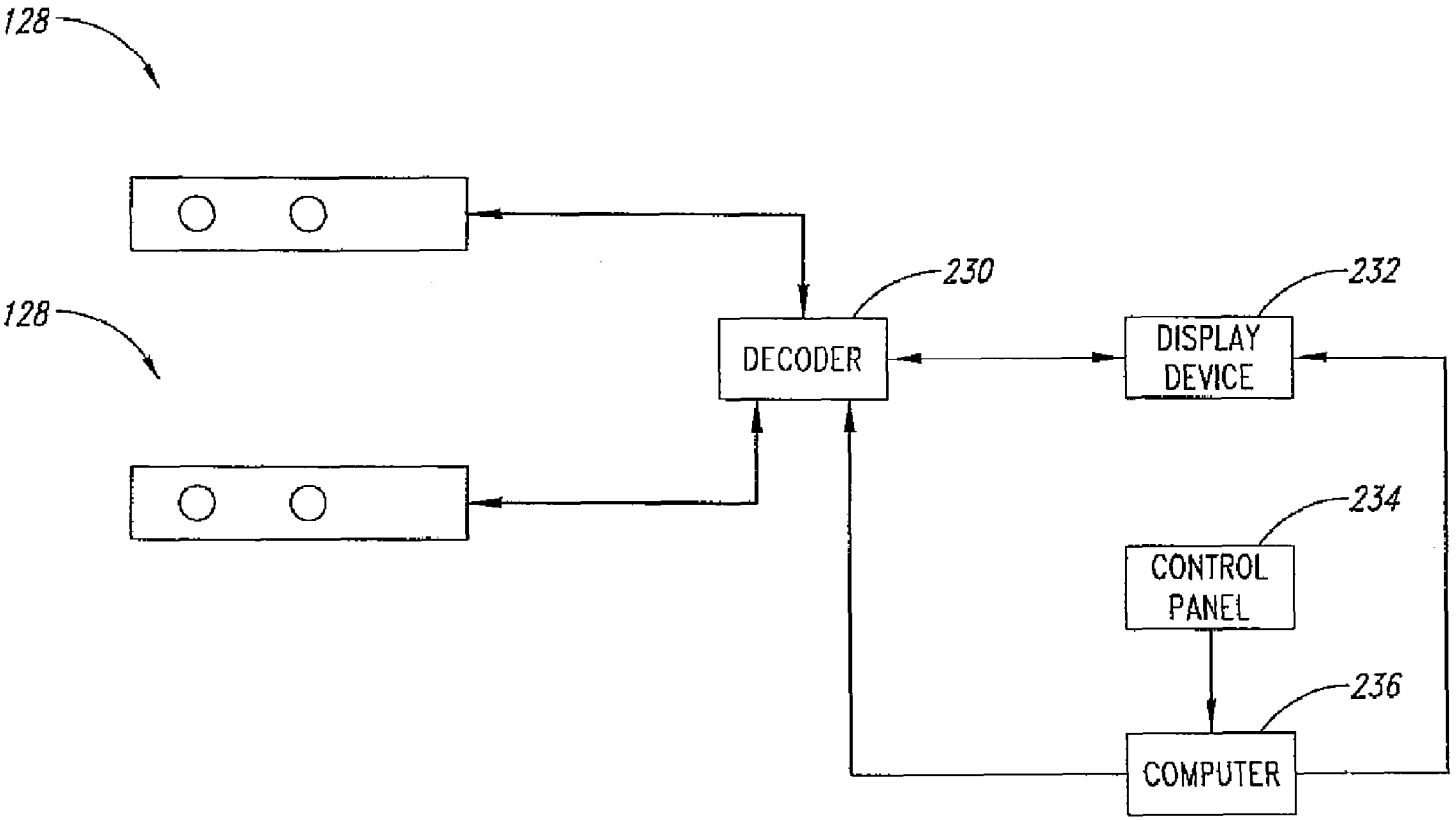
FIG. 2 is a block diagram of control means of a floating platform system according to another embodiment of the present invention.

As illustrated in FIG. 2, the one or more load cells 128 can be in electrical communication with a decoder 230, which in turn is in electrical communication with a display device 232 operable to display an indication of the magnitude of the compressive force F, received from the decoder 230. Additionally, or alternatively, in embodiments incorporating more than one biasing device 112, individual load cells 128 can communicate various respective magnitudes of the compressive forces F associated with each biasing device 112. Furthermore, the decoder 230 can be operable to communicate an indication of an average magnitude of the compressive forces F and/or a torsional rigidity of the floating platform system 100 based on the compressive forces F.

Additionally, or alternatively, a control panel 234 operable to manipulate a computing device 236 can convey a new indication of a desired magnitude for the compressive force F to be applied to the biasing device 112, communicated via the decoder 230. In such embodiments the biasing device 112 can incorporate hydraulics that affect the compressive force F and/or mechanical means such as a compression rod, either or both of which are in electrical communication with the decoder 230 and/or the computing device 236. The computing device 236 may also be in electrical communication with the display device 232 to provide visibility to the data being entered.

Referring to FIG. 1A, the floating platform system 100 may optionally comprise at least one mooring device 130 secured to the truss frame 106, the outer longitudinal beam members 102, 104 and/or the platform interface 126 (FIG. 1B). The mooring device 130 may be used to secure any object such as watercraft to the floating platform system 100. The floating platform system 100 may also include at least one optional end member 132 secured to the truss frame 106, the outer longitudinal beam members 102, 104 or any other structure of the floating platform system 100 toward a longitudinal boundary of the floating platform system 100. The end member 132 may add to the transverse strength and aid in maintaining a shape of the floating platform system 100.

In the illustrated embodiment of FIG. 1A, the end member 132 is secured to the outer longitudinal beam members 102, 104 via angled splice plates 134 and threaded fasteners 136. However, the end member 132 may be secured by any suitable securing means such as mechanical fasteners, water resistant bonding methods, and/or various mating mechanisms.

Figure 3A:
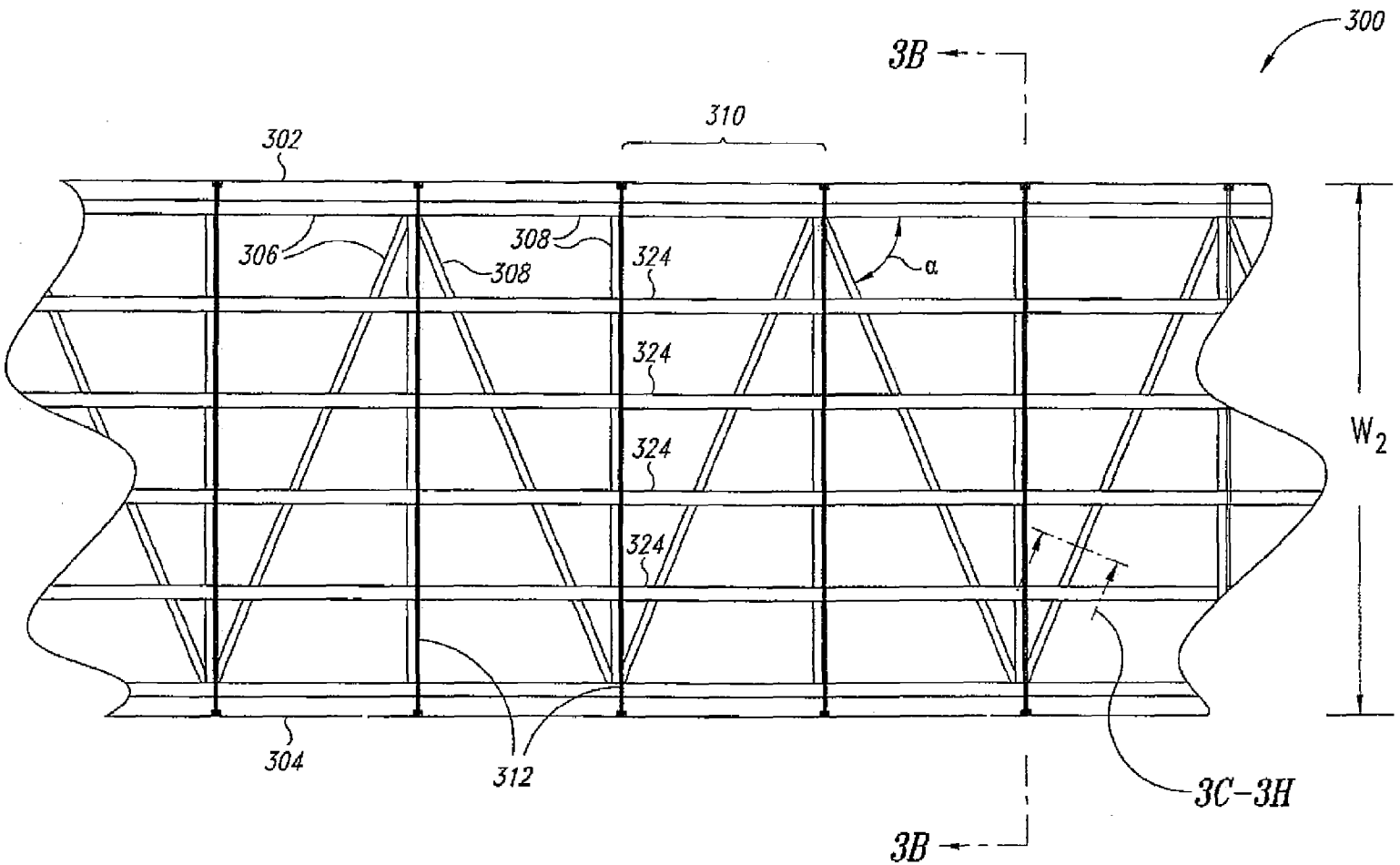
FIG. 3A is a partial top view of a floating platform system according to yet another embodiment of the present invention.

FIG. 3A illustrates a floating platform system 300 according to another embodiment of the present invention. As illustrated in FIG. 3A, a width W2 and length (not shown) of the floating platform system 300 can vary. For example, FIG. 1A illustrates the floating platform system 100 having width W1 while FIG. 3A illustrates the floating platform system 300 having width W2. Additionally, or alternatively, designs for different applications may vary the sizing of components such as the outer longitudinal beam members 302, 304, the upper inner longitudinal beam members 324, the truss frame 306 and/or an angle $\alpha$ of an arrangement of truss elements 308. Additionally, or alternatively, biasing devices 312 may be positioned on either side of truss elements 308 that extend transversely, for example in the floating platform systems 300 in which the truss frame 306 extends continuously across longitudinal bays 310.

Figure 3B:
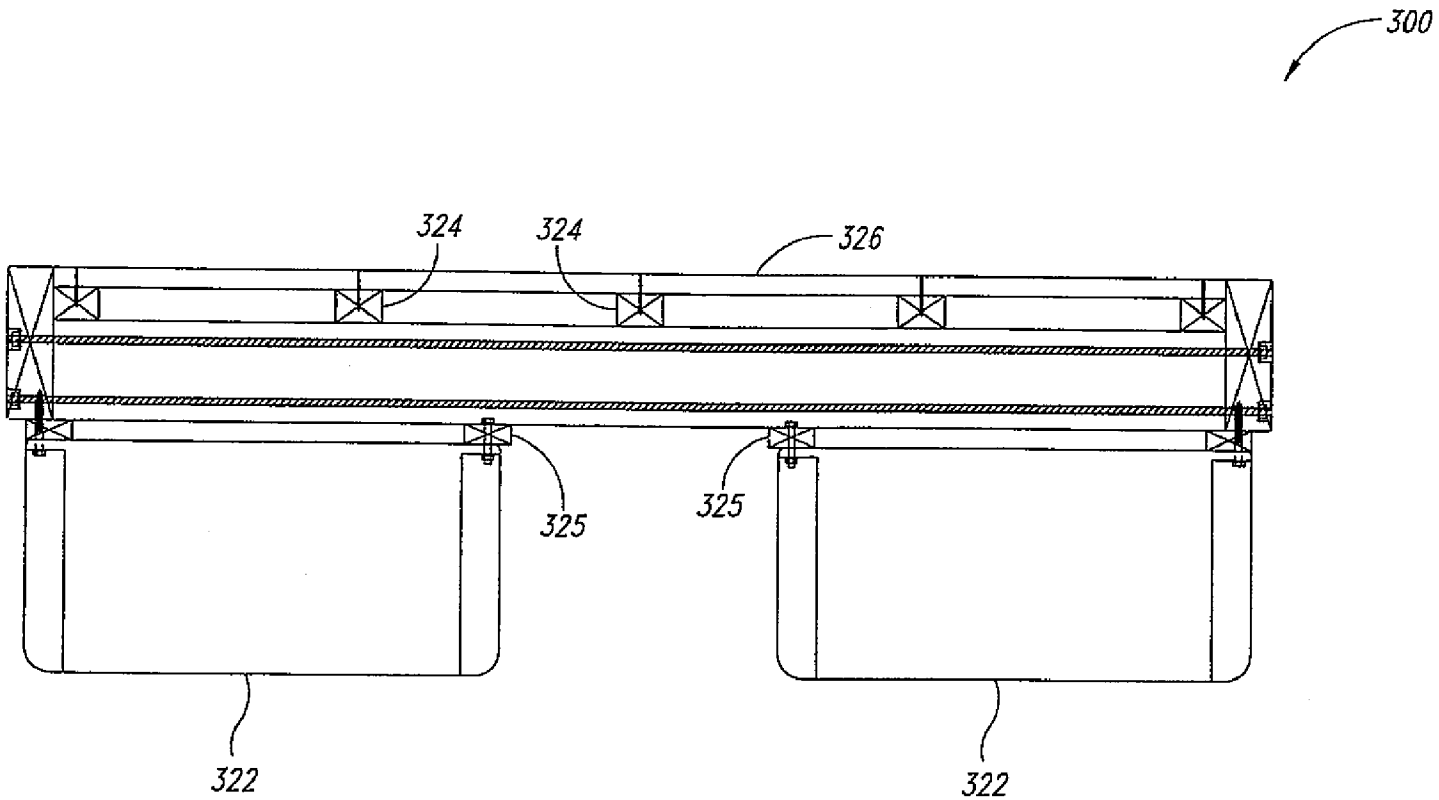
FIG. 3B is a cross-sectional view of the floating platform system of FIG. 3A, viewed along section 3B-3B.

Furthermore, as depicted in FIG. 3B, the floating platform system 300 may include more than one flotation device 322, secured using lower inner longitudinal beam members 325. Also, a platform interface 326 can mechanically fasten to upper inner longitudinal beam members 324. However, one of skill in the art having reviewed this disclosure can appreciate other securing means such as bonding, friction from compressive forces, mating mechanisms, or any other structural or non-structural securing means.

Figure 3C:
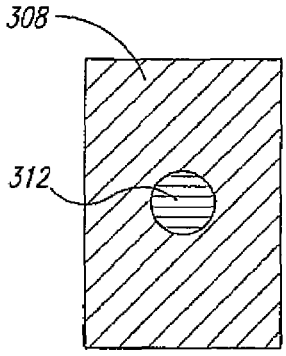
FIGS. 3C-3H are cross-sectional views of truss elements and biasing devices of a floating platform system according to various embodiments of the present invention.

The truss elements 308 can have any suitable cross-sectional shape. For example, in some embodiments, as shown in FIG. 3C, the truss elements can have a rectangular cross-section. In other embodiments, the cross-section of the truss elements 308 may be other shapes, such as a circle, ellipse, square, triangle, trapezoid or any other suitable shape that may be desired based on fit, space, and/or other design requirements. Furthermore, the biasing devices 312 may extend through the truss elements 308. FIG. 3C illustrates the biasing device 312 extending through a cross-sectional center of the truss element 308; however other configurations are possible.

Figure 3D:
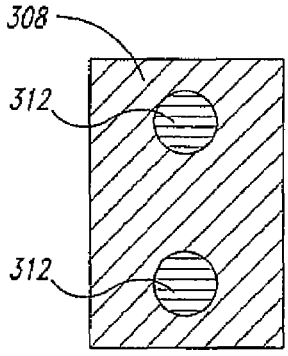

For example, as shown in FIG. 3D, the biasing devices 312 may extend through the truss elements 308 at a position different from the cross-sectional center of the truss elements 308. Furthermore, two or more biasing devices 312 may extend through the truss elements 308. Therefore, in addition to, or instead of, the transverse biasing devices 312 explained above, the biasing devices 312 could also extend diagonally through the diagonal truss elements 308.

Figure 3E:
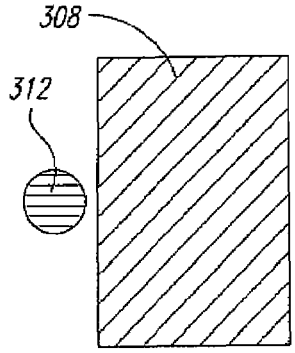
Figure 3F:
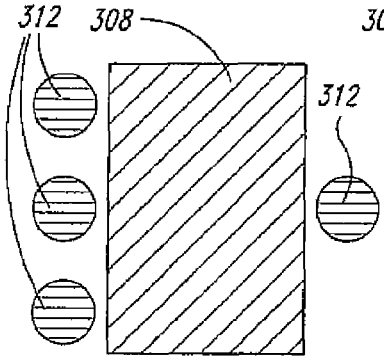

In yet other embodiments, as illustrated in FIG. 3E, the biasing devices 312 may extend along side of the truss elements 308 and the truss elements 308 can have a solid cross-section. FIG. 3E illustrates one biasing device 312 extending along one side of the truss element 308; however, more than one biasing device 312 may extend along either or both sides of the truss elements 308 as illustrated in FIG. 3F. In other embodiments the biasing devices can also extend alongside top or bottom sides or boundaries of the truss elements 308.

Figure 3G:
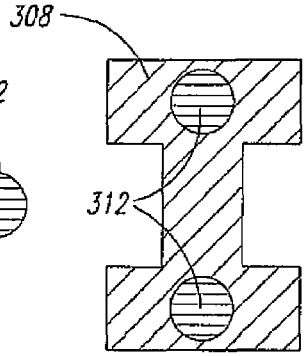
Figure 3H:
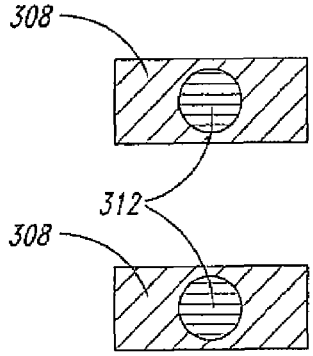

In still other embodiments, the truss elements 308 may have a cross-section that is not a typical shape. For example, as illustrated in FIG. 3G, the truss elements 308 may comprise an I-shape having at least one, or as depicted two, biasing devices 312 extending therethrough. In further embodiments, the truss elements 308 may comprise more than one spaced apart members as shown in FIG. 3H, each spaced apart member comprising at least one biasing device 312 extending therethrough. One of ordinary skill in the art having reviewed this disclosure will appreciate these and other modifications that can be made to the truss elements 308 and/or biasing devices 312 and their interaction and/or positioning with respect to each other.

For example, in yet a further embodiment, a floating platform system 400 may comprise hollow truss elements 408, such as pipes. The hollow truss elements 408 may be fabricated from metals, such as steel, aluminum, titanium, platinum, or any other metal, soft or hard woods, hard plastics, composite material such as carbon fiber, or any other material that maintains its shape under typical loading of floating platform applications and that can withstand compression forces induced by biasing devices 412, illustrated in FIG. 4B.

The hollow truss elements 408 can attach to outer longitudinal beam members 402 toward transverse boundaries of the floating platform system 400 via a coupling member 407 rigidly fixed to the outer longitudinal beam members 402. The coupling member 407 may be fixed to the outer longitudinal beam members 402 by any suitable means such as mechanical fasteners, industrial adhesives, mating mechanisms and/or by being integrated therein, for example by machining.

The coupling member 407 may comprise receptacles 409 receiving ends of the hollow truss elements 408. As illustrated in FIG. 4B, the biasing devices 412 can extend concentrically through the hollow truss elements 408, saving additional space and protecting the biasing devices 412 from weather and water exposure, which may deteriorate the biasing devices 412 over time. In other embodiments, the receptacles 409 can be formed within the outer longitudinal beam members 402 or alternatively directly affixed thereto, obviating the need for the coupling member 407. Furthermore, although the illustrated embodiment of FIG. 4 depicts hollow truss elements 408 that are circular in cross-section, in other embodiments the hollow truss elements 408 may comprise other typical cross-sectional shapes such as rectangular, triangular, trapezoidal, or other typical shapes, or non-typical cross-sectional shapes such as I-shapes or T-shapes.

Figure 4A:
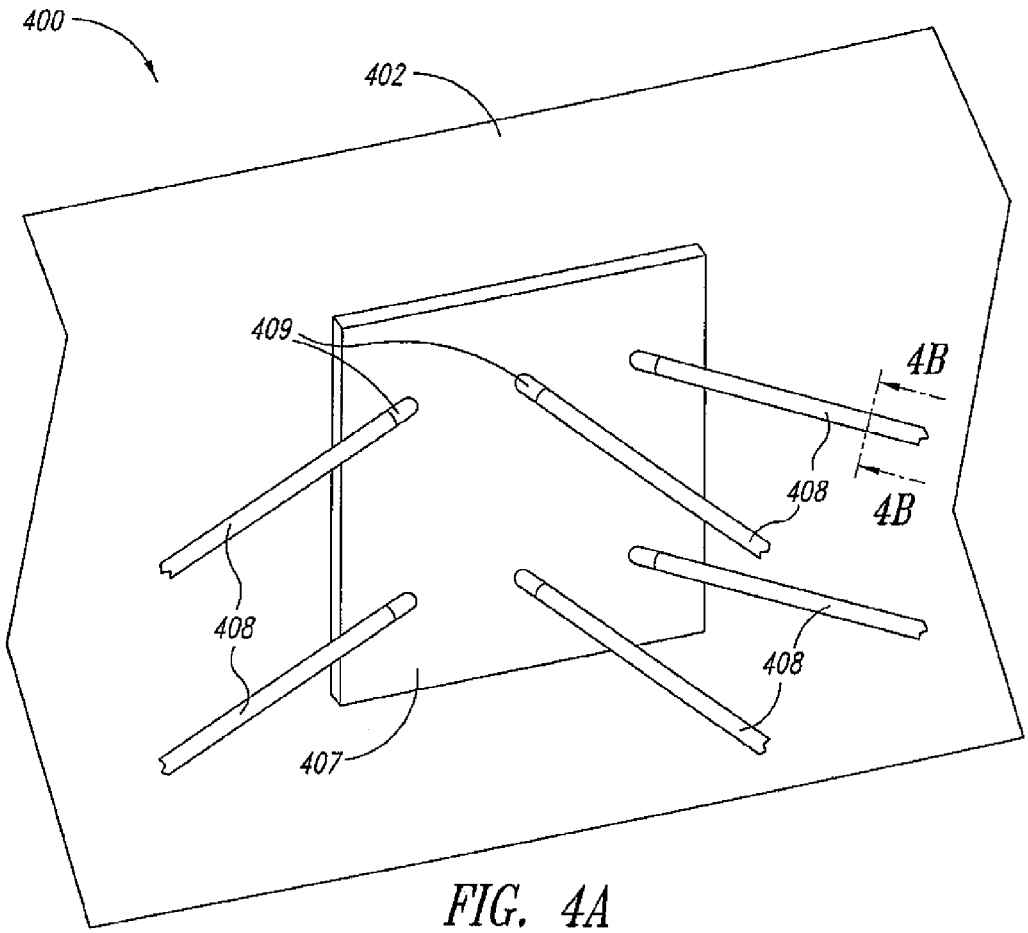
FIG. 4A is a close up view of a portion of a floating platform system according to still another embodiment of the present invention.
Figure 4B:
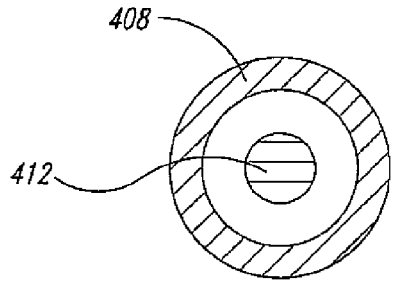
FIG. 4B is a cross-sectional view of a truss element of the floating platform system of FIG. 4A, viewed along section 4B-4B.

Since the hollow truss elements 408 can easily couple to the outer longitudinal beam members 402, embodiments similar to that of FIG. 4 may be well suited for applications in which components of the floating platform system 400 are shipped unassembled, and assembled at their destination.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims and equivalents thereof.

The invention claimed is:

1. A platform system configured to float on a body of water, comprising:

first and second longitudinal ends;

at least first and second longitudinal beam members extending between the first and second longitudinal ends;

a truss frame continuously extending from proximate the first longitudinal end to proximate the second longitudinal end, the truss frame having a plurality of truss elements forming at least one apex toward a lateral boundary of the floating platform system, the plurality of truss elements including at least one lateral truss member per each apex and extending substantially perpendicular to the first and second longitudinal beam members, the lateral truss member having an end adjacent the corresponding apex; and at least one biasing device per each apex, the biasing device having an end adjacent the corresponding apex and extending substantially parallel to, and adjacent, the lateral truss member, the biasing device operable to selectively apply a compressive force toward the apices of the truss frame.

2. The platform system of claim 1, further comprising a platform interface secured to at least one of the truss frame and the first and second longitudinal beam members, defining a surface of the platform system.

3. The platform system of claim 2, wherein the platform interface comprises at least one panel fabricated from a composite material.

4. The platform system of claim 2, further comprising a mooring device secured to at least one of the first and second longitudinal beam members, the truss member, and the platform interface.

5. The platform system of claim 2, further comprising at least one inner longitudinal beam member extending substantially parallel to, and laterally positioned between, the first and second longitudinal members.

6. The platform system of claim 5, wherein the at least one inner longitudinal beam member is positioned adjacent the platform interface.

7. The platform system of claim 5, further comprising at least one end member and securing means to secure the end member to at least one of the outer longitudinal beam members, the truss frame, the at least one inner longitudinal beam member, and the platform interface.

8. The platform system of claim 1, wherein the at least one biasing device extends through at least one truss element.

9. The platform system of claim 8, wherein the at least one truss element comprises a hollow cross-section.

10. The platform system of claim 9, wherein the at least one truss element is received in at least one receptacle rigidly attached to at least one longitudinal beam member.

11. The platform system of claim 10, further comprising a coupling member rigidly attaching the at least one receptacle to the at least one longitudinal beam member.

12. The platform system of claim 10, wherein the receptacle is formed in the longitudinal beam member.

13. The platform system of claim 1, further comprising at least one flotation device secured to at least one of the truss frame and the first and second outer longitudinal beam members.

14. The platform system of claim 1, wherein the at least one biasing device is coupled to at least one of the first and second longitudinal beam members and the longitudinal beam members are operable to distribute the force to the truss frame, increasing a torsional rigidity of the platform system.

15. The platform system of claim 14, wherein the force is a compressive force.

16. The platform system of claim 15, wherein the biasing device includes a compression rod.

17. The platform system of claim 16, wherein the compression rod comprises male and female members, an inner surface of the female member threadedly engaging an outer surface of the male member.

18. A method of constructing a floating platform comprising:

providing a truss frame continuously extending from proximate a first longitudinal end of the floating platform to proximate a second longitudinal end thereof, the truss frame having a plurality of truss elements forming a plurality of apices, and at least one lateral truss member per each apex;

positioning an end of the lateral truss member adjacent the corresponding apex;

respectively providing first and second outer longitudinal beam members toward opposing lateral boundaries of the truss frame;

coupling the truss frame to the first and second outer longitudinal beam members;

providing at least one biasing device per each apex, coupled to at least one of the truss frame and the outer longitudinal beam members, positioning an end of the biasing device adjacent the corresponding apex and extending the biasing device parallel to, and adjacent, the lateral truss member; and manipulating the biasing device to distribute a compressive force to the truss frame and maintain a torsional rigidity of the floating platform.

19. The method of claim 18, further comprising disposing at least one platform interface adjacent at least one of the truss frame and the first and second outer longitudinal beam members.

20. The method of claim 19, further comprising interposing at least one inner longitudinal beam member between the truss frame and the at least one platform interface.

21. The method of claim 20, further comprising disposing at least one flotation device adjacent at least one of the truss frame and the first and second outer longitudinal beam members.

22. The method of claim 21, further comprising interposing at least one inner longitudinal beam member between the truss frame and the at least one flotation device.

23. A method of inducing and maintaining a torsional rigidity of a floating platform having at least first and second outer longitudinal beam members, a truss frame having a plurality of truss elements forming a plurality of apices toward a lateral boundary of the floating platform system, and at least one biasing device operable to selectively apply a force in a substantially lateral direction toward at least one of the apices of the truss frame, the method comprising:

applying a compressive force from the biasing device to the truss frame toward each of the apices, distributed at intervals along an entire longitudinal length of the floating platform, the compressive force being applied in a direction parallel to a lateral member of the truss frame; and distributing the compressive force to the truss elements of the truss frame to induce and maintain the torsional rigidity of the floating platform.

* * * * *